US007498914B2

(12) United States Patent
Miyashita et al.

(10) Patent No.: US 7,498,914 B2
(45) Date of Patent: Mar. 3, 2009

(54) METHOD FOR MAGNETIZING RING MAGNET AND MAGNETIC ENCODER

(75) Inventors: Kunio Miyashita, Nagano (JP); Junji Koyama, Nagano (JP); Muneo Mitamura, Nagano (JP); Yasuo Sawamura, Nagano (JP)

(73) Assignee: Harmonic Drive Systems Inc., Tokyo (JP)

( * ) Notice: Subject to any disclaimer, the term of this patent is extended or adjusted under 35 U.S.C. 154(b) by 0 days.

(21) Appl. No.: 11/791,438

(22) PCT Filed: May 30, 2005

(86) PCT No.: PCT/JP2005/009844

§ 371 (c)(1),
(2), (4) Date: May 23, 2007

(87) PCT Pub. No.: WO2006/067878

PCT Pub. Date: Jun. 29, 2006

(65) Prior Publication Data

US 2008/0048811 A1 Feb. 28, 2008

(30) Foreign Application Priority Data

Dec. 20, 2004 (JP) ..... 2004-366961

(51) Int. Cl.
*H01F 13/00* (2006.01)
*H01F 7/20* (2006.01)

(52) U.S. Cl. ..... 335/284; 335/302

(58) Field of Classification Search ..... 335/284, 335/302–306

See application file for complete search history.

(56) References Cited

U.S. PATENT DOCUMENTS

| | | | | |
|---|---|---|---|---|
| 7,201,809 | B2 * | 4/2007 | Sato et al. | 148/103 |
| 2003/0118467 | A1 * | 6/2003 | Sato et al. | 419/66 |

FOREIGN PATENT DOCUMENTS

| | | | |
|---|---|---|---|
| JP | 52-038199 | | 3/1977 |
| JP | 56-122112 | | 9/1981 |
| JP | 63-182808 | | 7/1988 |
| JP | 03-233910 | | 10/1991 |
| JP | 2004111944 | A * | 4/2004 |

OTHER PUBLICATIONS

International Search Report dated Sep. 13, 2005 (2 pages).

* cited by examiner

*Primary Examiner*—Ramon M Barrera
(74) *Attorney, Agent, or Firm*—Flynn, Thiel, Boutell & Tanis, P.C.

(57) ABSTRACT

An insert member (42) having an identical permeability is fitted in the circular center hole(41*a*) of a magnetic ring (41) which is then fitted in the circular hollow section (43*a*) of a fitting-over member (43) having an identical permeability. Under that state, the magnetic ring (41) is placed in a parallel magnetic field. Lines of magnetic flux passing through the magnetic ring (41) held between the insert member (42) and the fitting-over member (43) become linear without substantially inclining against the parallel magnetic field. Under that state, harmonic noise causing a deterioration in detection precision will scarcely appear in the output of a magnetic sensor for detecting the rotating magnetic field of a ring magnet (40) obtained by performing two-pole magnetization on the magnetic ring (41). When the ring magnet (40) is employed, a deterioration in the detection precision of a magnetic encoder (1) due to the magnetization state of the ring magnet (40) can be avoided, and the deterioration in detection precision can be suppressed.

8 Claims, 7 Drawing Sheets

(a)

(b)

METHOD FOR MAGNETIZING RING MAGNET AND MAGNETIC ENCODER

TECHNICAL FIELD

The present invention relates to an improved method for magnetizing a bipolarly magnetized ring magnet for use in a magnetic encoder or the like, and further relates to a magnetic encoder whose detection accuracy is improved by using a ring magnet that has been bipolarly magnetized by the improved method.

BACKGROUND ART

Well-known magnetic encoders for detecting the rotation angle and other quantities of a rotating body include devices provided with a bipolarly magnetized ring magnet, as shown in FIG. 6(*a*). In such a magnetic encoder 1, a bipolarly magnetized ring magnet 2 is attached so as to rotate integrally with the rotating body to be detected (not shown). Two magnetic sensors 3X, 3Y are positioned at a 90-degree angular spacing in the circumferential direction facing the outer circumferential surface 2*a* of the ring magnet 2 across a set gap.

When the ring magnet 2 rotates together with the rotating body, sinusoid detection signals that are shifted in phase by 90 degrees are output from the magnetic sensors 3X, 3Y. For example, the X-phase detection signal shown by the thick line in FIG. 6(*b*) is output from the magnetic sensor 3X, and the Y-phase detection signal shown by the thin line is output from the magnetic sensor 3Y.

These detection signals, which have phases shifted by 90 degrees, are fed to a computing part 4. The computing part 4 calculates the angle of rotation of the ring magnet 2 on the basis of the waveforms of the detection signals and generates encoder pulse signals that represent the angle of rotation, direction of rotation, and other properties. The encoder pulse signals are fed to a drive control circuit (not shown) or other component of the rotating body.

The ring magnet 2 of the bipolar magnetic encoder 1 constructed in this fashion is magnetized by placing a magnetic ring 12 within the parallel magnetic field shown by the arrow in FIG. 7(*a*). The magnetic permeability of the air is lower than the magnetic permeability of the magnetic ring 12. The magnetic permeability of the commonly used magnetic ring 12 is 1.1 to 1.3, whereas the magnetic permeability of air is 1.0. Therefore, as shown in FIG. 7(*b*), when the magnetic ring 12 is in a parallel magnetic field, the direction of the magnetic flux is bent at the inner circumferential surface A and the outer circumferential surface B of the magnetic ring 12, and the direction of the magnetic flux passing within the magnetic ring 12 is inclined relative to the parallel magnetic field.

When the rotating magnetic field of the bipolarly magnetized ring magnet 2 is detected by a magnetic sensor in this state, odd-order harmonic components are generated as noise in the detected waveforms as a result of the slight incline of the magnetic flux during magnetization. As a result, an adverse effect occurs in which the noise components have the effect of degrading the accuracy of detecting the angle of rotation when this ring magnet 2 is used in the fabrication of the magnetic encoder shown in FIG. 6(*a*).

DISCLOSURE OF THE INTENTION

In view of these problems, it is an object of the present invention to provide a magnetizing method that allows a ring magnet to be bipolarly magnetized in an appropriate fashion.

It is also an object of the present invention to provide a magnetic encoder in which a ring magnet that is bipolarly magnetized in an appropriate fashion is used to enable the accurate detection of the angle of rotation and the like.

In order to achieve the aforementioned objects, the method for magnetizing a ring magnet according to the present invention is characterized in comprising an insertion member mounting step for mounting an insertion member in a ring composed of a magnetic material to obtain a state in which an inner circumferential surface of the ring is covered, the magnetic permeability of the insertion member being substantially the same as that of the ring; and a magnetizing step for positioning the ring within a parallel magnetic field and bipolarly magnetizing the ring in this state.

A tube or a cylinder having an outside diameter capable of being fit into the ring may be used as the insertion member.

In the magnetizing method according to the present invention, bipolar magnetization is performed in a state in which the inner circumferential surface of a magnetic ring is covered by an insertion member that has substantially the same magnetic permeability as the magnetic ring. Bending of the direction of magnetic flux in the inner circumferential surface of the magnetic ring can therefore be avoided, unlike the case in which the inner circumferential surface of the magnetic ring forms an interface with air, which has a different magnetic permeability. The extent to which the magnetic flux formed within the magnetic ring is inclined relative to the parallel magnetic field can therefore be minimized.

The harmonic noise included in the detection output of the rotational magnetic field of a ring magnet that is bipolarly magnetized in this fashion can therefore be minimized in magnetic sensors in which this magnet is used. Therefore, a lowering of the detection accuracy of a magnetic encoder due to the state of magnetization of the ring magnet can be minimized by using a ring magnet bipolarly magnetized according the method of the present invention.

The method for magnetizing a ring magnet according to present invention is further characterized in comprising an encircling member mounting step for mounting an encircling member on a ring composed of a magnetic material to obtain a state in which an outer circumferential surface of the ring is covered, the magnetic permeability of the encircling member being substantially the same as that of the ring; and a magnetizing step for positioning the ring within a parallel magnetic field and bipolarly magnetizing the ring in a state in which the encircling member is mounted.

A tube provided with a circular hollow part having an inside diameter capable of fitting over the ring may be used as the encircling member.

In the magnetizing method according to the present invention, bipolar magnetization is performed in a state in which the outer circumferential surface of a magnetic ring is covered by an encircling member that has substantially the same magnetic permeability as the magnetic ring. Bending of the direction of magnetic flux in the outer circumferential surface of the magnetic ring can therefore be avoided, unlike the case in which the outer circumferential surface of the magnetic ring forms an interface with air, which has a different magnetic permeability. The extent to which the magnetic flux formed within the magnetic ring is inclined relative to the parallel magnetic field can therefore be minimized.

The harmonic noise included in the detection output of the rotational magnetic field of a ring magnet that is bipolarly magnetized in this fashion can therefore be minimized in magnetic sensors in which this magnet is used. Therefore, a lowering of the detection accuracy of a magnetic encoder due to the state of magnetization of the ring magnet can be minimized by using a ring magnet bipolarly magnetized according to the method of the present invention.

The magnetizing method according to the present invention is further characterized in comprising the insertion member mounting step, the encircling member mounting step, and the magnetizing step. The insertion member mounting step and the encircling member mounting step may be performed simultaneously or sequentially.

In the magnetizing method according to the present invention, bipolar magnetization is performed in a state in which the inner circumferential surface and the outer circumferential surface of a magnetic ring are covered by an insertion member and an encircling member that have substantially the same magnetic permeability as the magnetic ring. Inclination and other anomalies in the magnetic flux in the inner circumferential surface and the outer circumferential surface of the magnetic ring therefore do not occur, unlike the case in which the inner circumferential surface and the outer circumferential surface of the magnetic ring form an interface with air, which has a different magnetic permeability, and the magnetic flux formed within the magnetic ring can be made to have substantially the same direction as the parallel magnetic field.

The harmonic noise that occurs in the detection output of the rotational magnetic field of the ring magnet due to the magnetization state of the ring magnet is thus substantially absent in magnetic sensors that use a ring magnet that is bipolarly magnetized in this fashion. A magnetic encoder having a high detection accuracy can therefore be implemented by using a ring magnet bipolarly magnetized according the method of the present invention.

The magnetic encoder according to the present invention is characterized in comprising a bipolarly magnetized ring magnet that is coaxially attached to a rotating body; a pair of magnetic sensors that face an outer circumferential surface of the ring magnet across a prescribed gap and that are positioned along a circumferential direction of the outer circumferential surface at an angular spacing of 90 degrees; and a computing part for generating an encoder signal on the basis of an output from the magnetic sensors, wherein the ring magnet is magnetized by the magnetizing method according to the present invention.

| [KEY] | |
|---|---|
| 1 | Magnetic encoder |
| 2 | Ring magnet |
| 3X, 3Y | Magnetic sensor |
| 4 | Computing part |
| 20, 30, 40 | Bipolarly magnetized ring magnet |
| 21, 41 | Magnetic ring |
| 21a, 41a | Circular central hole of the magnetic ring |
| 21b, 41b | Inner circumferential surface of the magnetic ring |
| 41c | Outer circumferential surface of the magnetic ring |
| 22, 32, 42 | Insertion member |
| 32a | Central hole |
| 43, 53, 63 | Encircling member |
| 43a | Circular hollow part |

BEST MODE FOR CARRYING OUT THE INVENTION

A method for magnetizing a ring magnet for use in a magnetic encoder in which the present invention is applied will be described below with reference to the drawings.

EMBODIMENT 1

Figure 1:
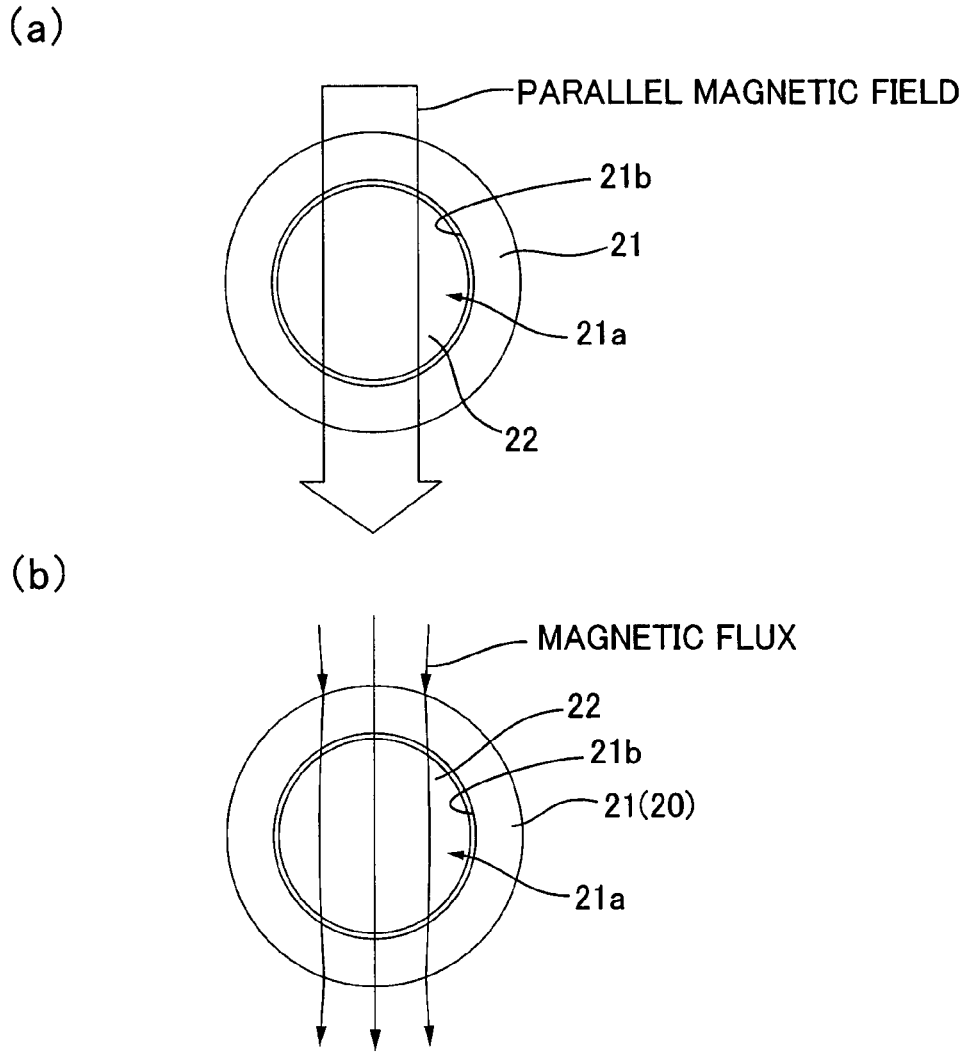
FIG. 1(*a*) is a descriptive diagram that shows the method for magnetizing a ring magnet of Embodiment 1 according to the present invention, and FIG. 1(*b*) is a descriptive diagram that shows the state of the magnetic flux that passes through the magnetic ring.

FIG. 1 is a descriptive diagram that shows an example of the method for magnetizing a ring magnet. A magnetic ring 21 having a central circular hole 21*a* is produced, as shown in FIG. 1(*a*). A cylindrical insertion member 22 is constructed from a material having substantially the same magnetic permeability as the magnetic ring 21. The outside diameter of the insertion member 22 allows the insertion member 22 to be removably fit inside the central circular hole 21*a*. A cylindrical insertion member 22 that has the same magnetic permeability as the magnetic ring 21 may be constructed from, e.g., the same material as the magnetic ring 21. The thickness (the length in the axial direction) of the cylindrical insertion member 22 is preferably equal to or greater than the thickness of the magnetic ring 21.

The cylindrical insertion member 22 is then fit into the central circular hole 21*a* of the magnetic ring 21 (insertion member mounting step). As a result, the circular inner circumferential surface 21*b* of the magnetic ring 21 is covered by the insertion member 22.

The magnetic ring 21 in which the insertion member 22 has been mounted is then placed within a parallel magnetic field, shown by the arrow in FIG. 1(*a*). The magnetic flux in this state passes through the inner circumferential surface 21*b* of the magnetic ring 21 without bending, as shown by the arrows in FIG. 1(*b*). The magnetic flux passing within the magnetic ring 21 can therefore be formed in a substantially straight line in which the inclination relative to the direction of the parallel magnetic field is lesser than in a case in which only the magnetic ring 21 is placed within the parallel magnetic field, as in conventional methods. The magnetic ring 21 is bipolarly magnetized in this state, whereby a ring magnet 20 can be obtained (magnetizing step).

Figure 6:
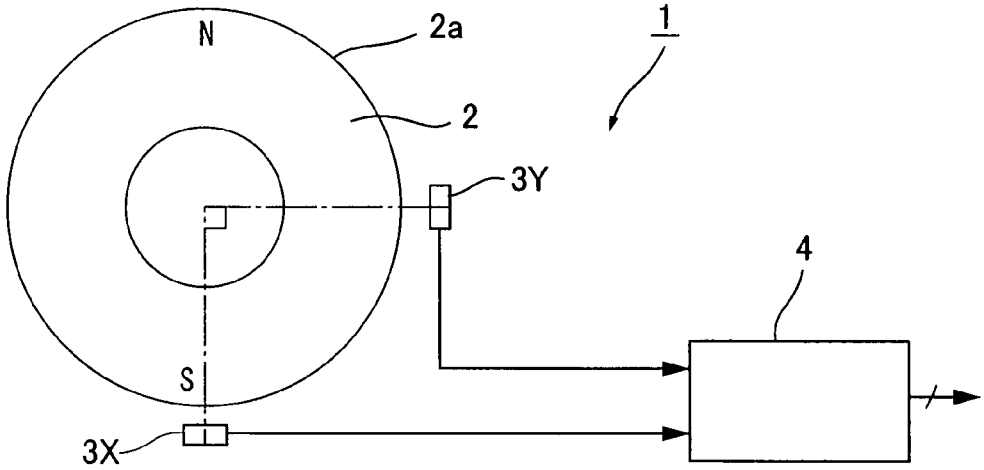
FIG. 6(*a*) is a schematic structural diagram that shows a magnetic encoder provided with a bipolarly magnetized-ring magnet, and FIG. 6(*b*) is a waveform diagram that shows the detection waveforms of the pair of magnetic sensors of FIG. 6(*a*).
Figure 6:
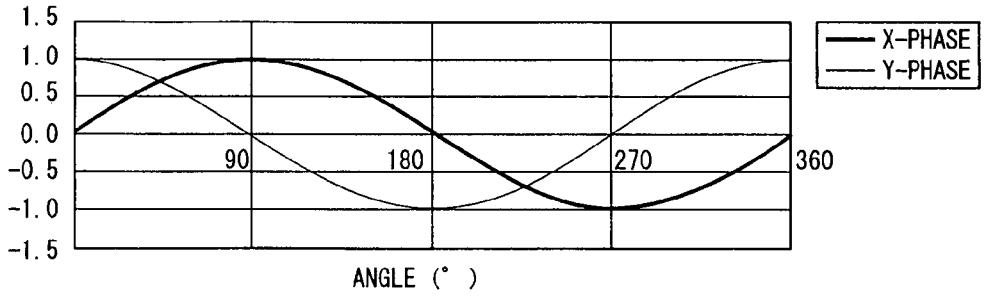
Figure 7:
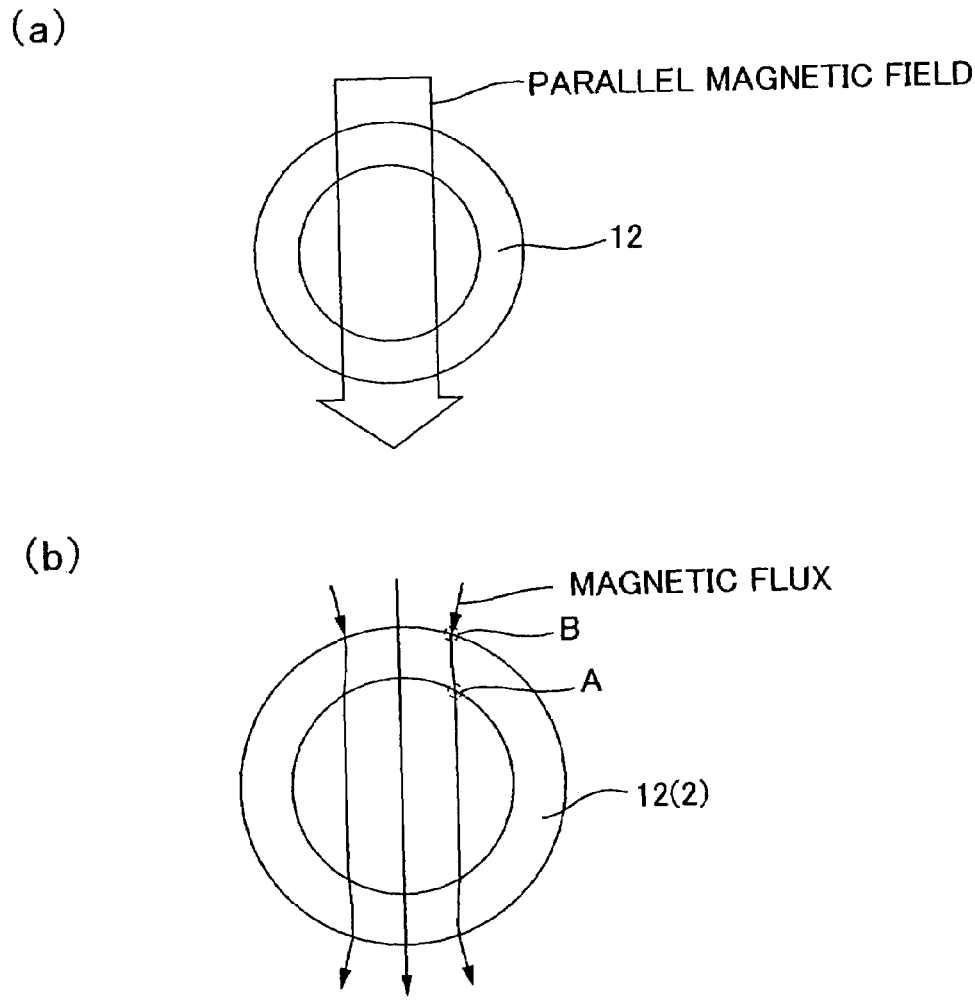
FIG. 7 (PRIOR ART)
FIG. 7 is a descriptive diagram that demonstrates the problems of conventional magnetizing methods.

When the ring magnet 20 magnetized in this fashion is used as the ring magnet 2 of the magnetic encoder 1 shown in FIG. 6, odd-order harmonic components will be only minimally present in the detection waveforms of the pair of magnetic sensors 3X, 3Y. A lowering of the detection accuracy of the magnetic encoder 1 due to these noise components can therefore be minimized.

Figure 2:
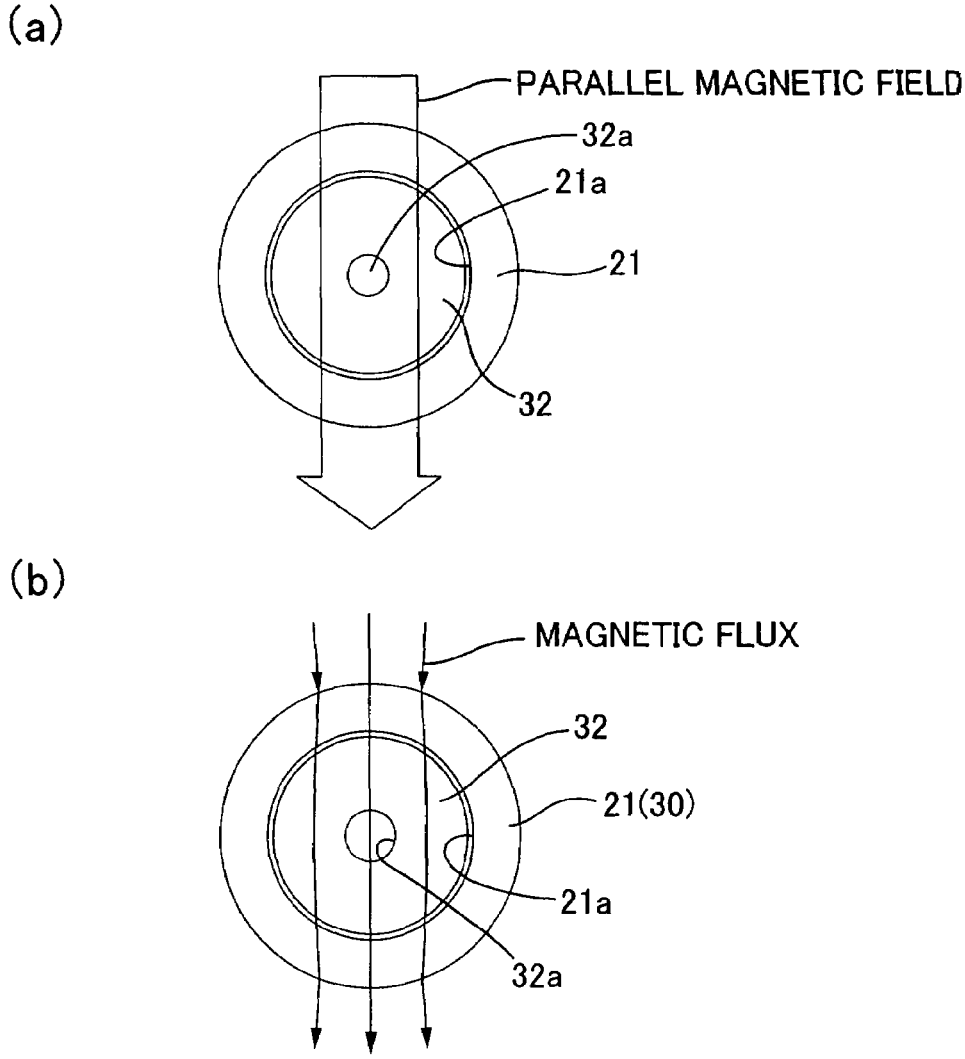
FIG. 2(*a*) is a descriptive diagram that shows another example of the insertion member used in the magnetizing method of FIG. 1, and FIG. 2(*b*) is a descriptive diagram that shows the state of the magnetic flux that passes through the magnetic ring.

As shown in FIG. 2(*a*), a tubular insertion member 32 formed having a central hole 32*a* may also be used instead of the cylindrical insertion member 22. The tubular insertion member 32 in this case is also formed from a material having substantially the same magnetic permeability as the magnetic ring 21 or from the same material as the magnetic ring 21. The central hole 32*a* of the tubular insertion member 32 must be small enough so that the magnetic flux lines passing through the magnetic ring 21 are not inclined. Inclination relative to the direction of the parallel magnetic field can also be minimized in the magnetic flux lines passing through the magnetic ring 21 when this insertion member 32 is used, as shown in FIG. 2(*b*). A lowering of the detection accuracy of the magnetic encoder can therefore also be minimized when using a ring magnet 30 that was magnetized using the tubular insertion member 32.

EMBODIMENT 2

Figure 3:
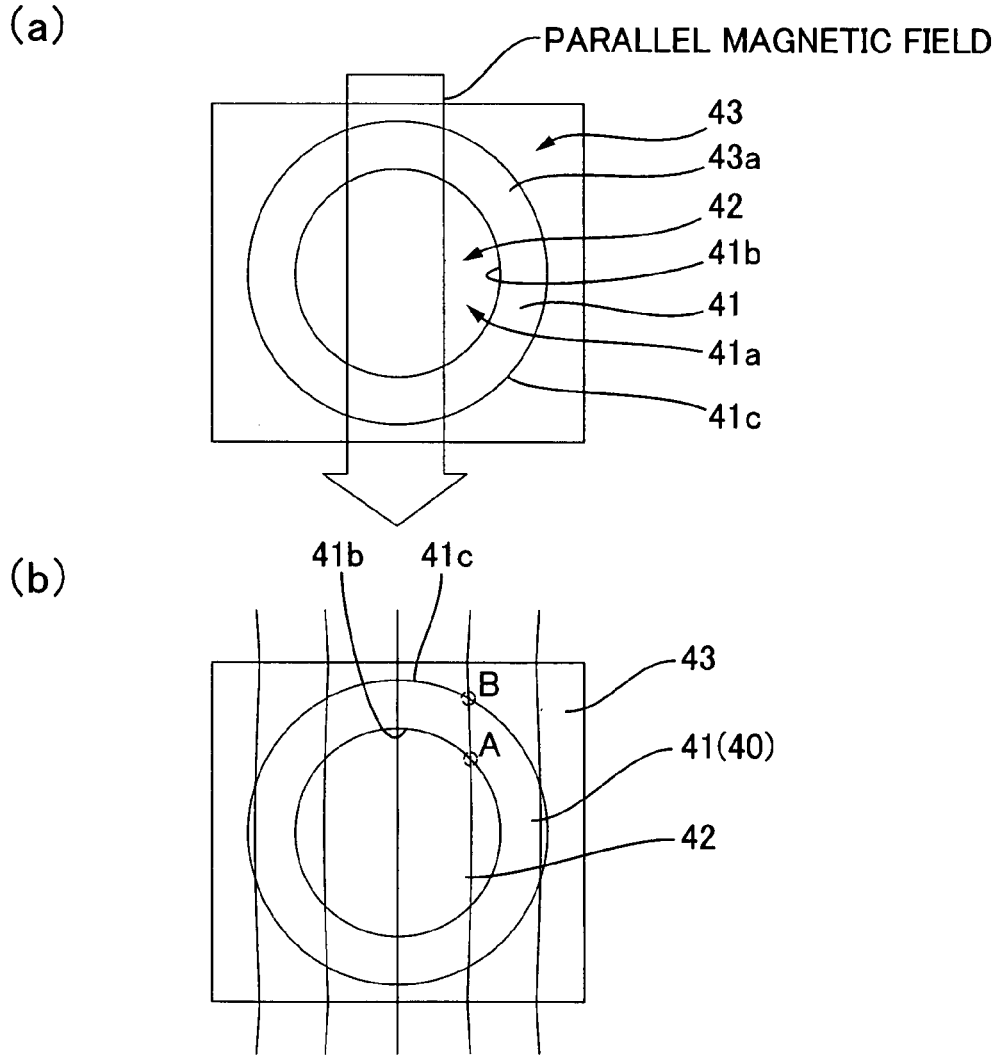
FIG. 3(*a*) is a descriptive diagram that shows the method for magnetizing a ring magnet of Embodiment 2 according to the present invention, and FIG. 3(*b*) is a descriptive diagram that shows the state of the magnetic flux that passes through the magnetic ring.

FIG. 3 is a descriptive diagram that shows another example of the method for magnetizing a ring magnet according to the present invention. In the method of the present example, a magnetic ring 41 is structured to form a central circular hole 41*a*, as shown in FIG. 3(*a*). A cylindrical insertion member 42 is constructed from a material having substantially the same magnetic permeability as the magnetic ring 41. The outside diameter of the insertion member 42 allows the insertion member 42 to be removably fit inside the central circular hole 41*a*. A cylindrical insertion member 42 that has the same magnetic permeability as the magnetic ring 41 may be constructed from, e.g., the same material as the magnetic ring 41. The thickness (the length in the axial direction) of the cylindrical insertion member 42 is preferably equal to or greater than the thickness of the magnetic ring 41.

A rectangular encircling member 43 provided with a circular hollow part 43*a* having an inside diameter that allows the magnetic ring 41 to be removably fitted is constructed from a material having substantially the same magnetic permeability as the magnetic ring 41. An encircling member 43 that has the same magnetic permeability as the magnetic ring 41 may be constructed from, e.g., the same material as the magnetic ring 41. The thickness (the length in the axial direction) of the encircling member 43 is preferably equal to or greater than the thickness of the magnetic ring 41.

The cylindrical insertion member 42 is then fit into the central circular hole 41*a* of the magnetic ring 41 (insertion member mounting step). As a result, the circular inner circumferential surface 41*b* of the magnetic ring 41 is covered by the insertion member 42. The magnetic ring 41 is also fit into the circular hollow part 43*a* of the encircling member 43, and the circular outer circumferential surface 41*c* of the magnetic ring 41 is covered by the encircling member 43 (encircling member mounting step). The mounting of the insertion member 42 and the encircling member 43 may be performed simultaneously, or the encircling member 43 may be mounted first.

The magnetic ring 41 to which the insertion member 42 and the encircling member 43 have been mounted is then placed within a parallel magnetic field, shown by the arrow in FIG. 3(*a*). The magnetic flux in this state passes through the inner circumferential surface 41*b* and the outer circumferential surface 41*c* of the magnetic ring 41 without bending, as shown by the arrows in FIG. 3(*b*). The magnetic flux passing within the magnetic ring 41 can therefore be formed in a straight line that is substantially parallel to the direction of the parallel magnetic field. The magnetic ring 41 is bipolarly magnetized in this state, whereby a ring magnet 40 can be obtained (magnetizing step).

When the ring magnet 40 magnetized in this fashion is used as the ring magnet 2 of the magnetic encoder 1 shown in FIG. 6, odd-order harmonic components will be only minimally present in the detection waveforms of the pair of magnetic sensors 3X, 3Y. A lowering in the detection accuracy of the magnetic encoder 1 due to these noise components can therefore be verifiably avoided.

Figure 4:
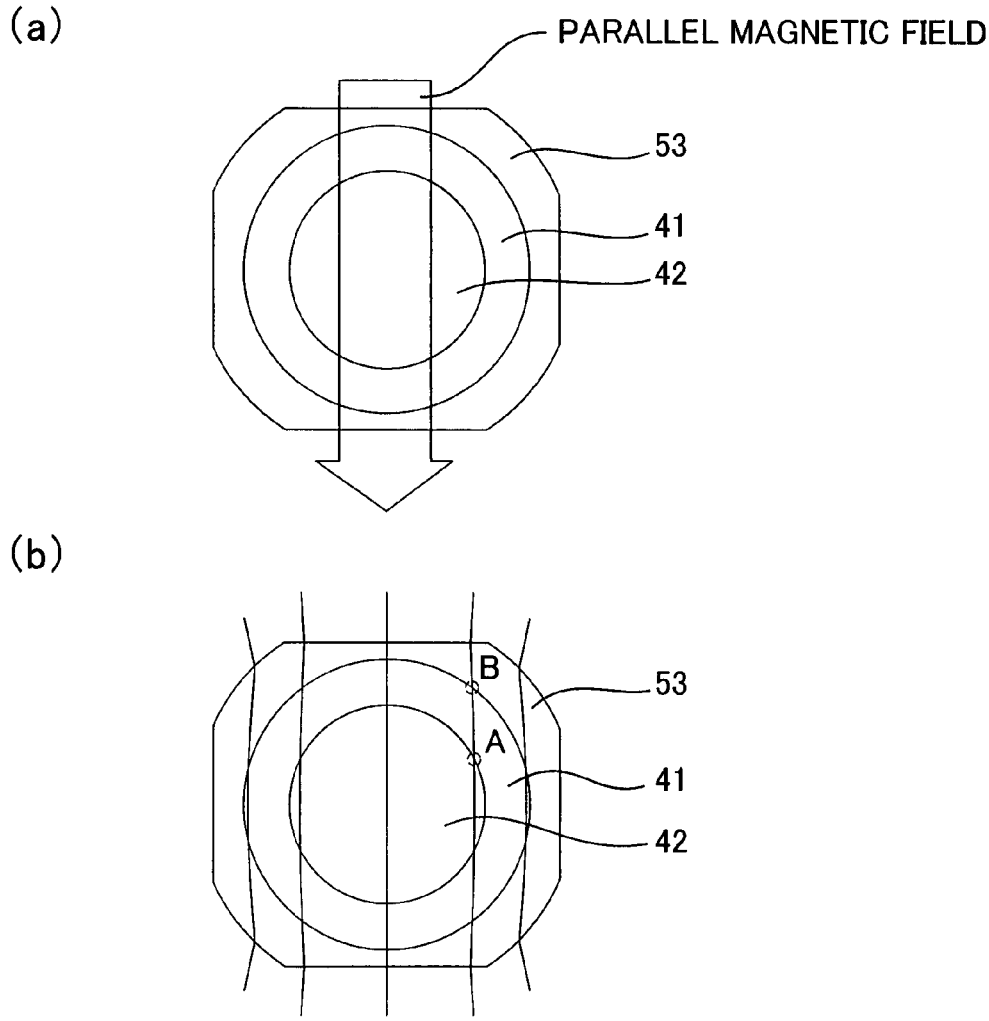
FIG. 4(*a*) is a descriptive diagram that shows another example of the encircling member used in the magnetizing method of FIG. 3, and FIG. 4(*b*) is a descriptive diagram that shows the state of the magnetic flux that passes through the magnetic ring.
Figure 5:
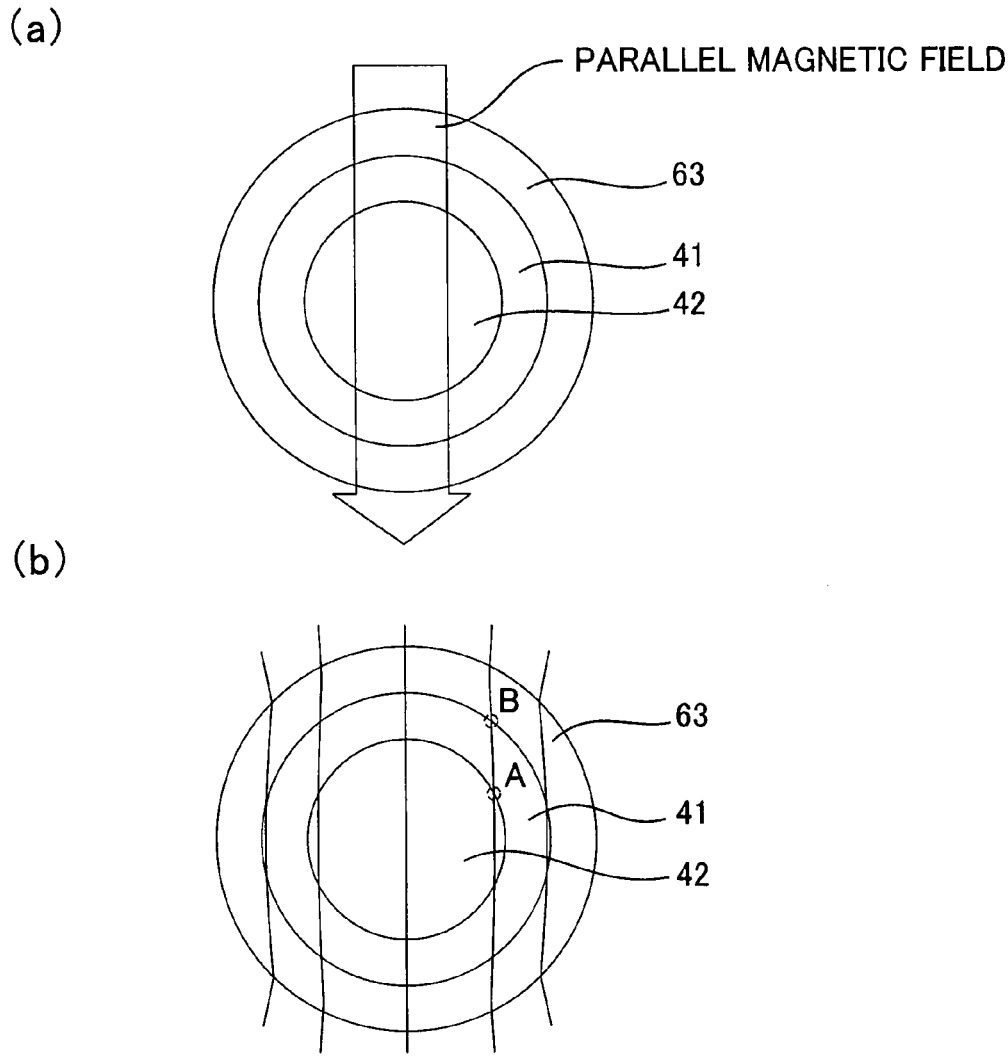
FIG. 5(*a*) is a descriptive diagram that shows a further example of the encircling member used in the magnetizing method of FIG. 3, and FIG. 5(*b*) is a descriptive diagram that shows the state of the magnetic flux that passes through the magnetic ring.

A quasi-rectangular encircling member 53 whose four rectangular corners have been cut into arc shapes can also be used as the encircling member 43, as shown in FIG. 4(*a*). A tubular encircling member 63 may also be used, as shown in FIG. 5*a*). A magnetic flux that is substantially parallel to the direction of the parallel magnetic field can be formed within the magnetic ring 41 in either case, as shown in FIGS. 4(*b*) and 5(*b*), respectively.

The insertion member 32 having the central hole 32*a* as shown in FIG. 2 may also be used as the insertion member 42.

The magnetizing method of the present example involves mounting the insertion member 42 and the encircling member 43, which have substantially the same magnetic permeability as the magnetic ring 41, on the inside and outside, respectively, of the magnetic ring 41; placing the magnetic ring 41 in a parallel magnetic field in this state; and performing bipolar magnetization. As a result, a magnetic flux that is substantially parallel to the direction of the parallel magnetic field is formed within the magnetic ring 41. Odd-order harmonic noise is therefore substantially absent in the detection output waveforms in a magnetic encoder that uses the ring magnet 40 manufactured according to the present example. A magnetic encoder having excellent detection accuracy can therefore be implemented.

OTHER EMBODIMENTS

Bipolar magnetization may also be performed with only an encircling member mounted on the magnetic ring. Any of the encircling members 43, 53, 63 shown in FIGS. 3, 4, 5, for example, may be mounted on the magnetic ring 41, and bipolar magnetization may be performed in this state. Even when a magnet magnetized in this fashion is used, the detection accuracy of the magnetic encoder can be improved in comparison with the use of a magnet bipolarly magnetized by placing only the magnetic ring into a parallel magnetic field.

The invention claimed is:

1. A method for magnetizing a ring magnet, comprising the steps of:

mounting an insertion member in a ring composed of a magnetic material to obtain a state in which an inner circumferential surface of the ring is covered by an outer circumferential surface of the insertion member, the magnetic permeability of the insertion member being the same as that of the ring; and positioning the ring within a parallel magnetic field and bipolarly magnetizing the ring in a state in which the insertion member is mounted therein.

2. The method for magnetizing a ring magnet according to claim 1, characterized in that the insertion member is tubular or cylindrical in shape and has an outside diameter that allows the insertion member to be fit into the ring.

3. A method for magnetizing a ring magnet, comprising the steps of:

mounting an encircling member on a ring composed of a magnetic material to obtain a state in which an outer circumferential surface of the ring is covered by an inner circumferential surface of the encircling member, the magnetic permeability of the encircling member being the same as that of the ring; and positioning the ring within a parallel magnetic field and bipolarly magnetizing the ring in a state in which the encircling member is mounted therearound.

4. The method for magnetizing a ring magnet according to claim 3, characterized in that the encircling member is cylindrical in shape and is provided with a circular hollow part having an inside diameter that allows the encircling member to be fit over the ring.

5. A method for magnetizing a ring magnet, comprising:

mounting an insertion member in a ring composed of a magnetic material to obtain a state in which an inner circumferential surface of the ring is covered by an outer circumferential surface of the insertion member, the magnetic permeability of the insertion member being the same as that of the ring;

mounting an encircling member on the ring in a state in which an outer circumferential surface of the ring is covered, the magnetic permeability of the encircling member being the same as that of the ring; and positioning the ring within a parallel magnetic field and bipolarly magnetizing the ring in a state in which the insertion member is mounted therein and the encircling member is mounted therearound.

6. The method for magnetizing a ring magnet according to claim 5, characterized in that the insertion member is tubular or cylindrical in shape and has an outside diameter that allows the insertion member to fit into the ring.

7. The method for magnetizing a ring magnet according to claim 5, characterized in that the encircling member is cylindrical in shape and is provided with a circular hollow part whose inside diameter allows the encircling member to be fit over the ring.

8. A magnetic encoder, characterized in comprising:

a bipolarly magnetized ring magnet that is coaxially attached to a rotating body;

a pair of magnetic sensors that face an outer circumferential surface of the ring magnet across a prescribed gap and that are positioned along a circumferential direction of the outer circumferential surface at an angular spacing of 90 degrees; and a computing part for generating an encoder signal on the basis of an output from the magnetic sensors, wherein the ring magnet is bipolarly magnetized by the method according to claim 1.

* * * * *